US010783787B2

(12) United States Patent
Hourdos et al.

(10) Patent No.: US 10,783,787 B2
(45) Date of Patent: Sep. 22, 2020

(54) FREEWAY QUEUE WARNING SYSTEM

(71) Applicant: Regents of the University of Minnesota, Minneapolis, MN (US)

(72) Inventors: John Hourdos, Minneapolis, MN (US); Zhejun Liu, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 101 days.

(21) Appl. No.: 15/993,148

(22) Filed: May 30, 2018

(65) Prior Publication Data

US 2018/0350239 A1 Dec. 6, 2018

Related U.S. Application Data

(60) Provisional application No. 62/512,999, filed on May 31, 2017.

(51) Int. Cl.

| | |
|---|---|
| ***G08G 1/16*** | (2006.01) |
| ***G08G 1/01*** | (2006.01) |
| ***G08G 1/0967*** | (2006.01) |

(52) U.S. Cl.

CPC ..... *G08G 1/164* (2013.01); *G08G 1/0112* (2013.01); *G08G 1/0116* (2013.01); *G08G 1/0133* (2013.01); *G08G 1/0141* (2013.01); *G08G 1/096775* (2013.01)

(58) Field of Classification Search

CPC .... G08G 1/164; G08G 1/0112; G08G 1/0116; G08G 1/0133; G08G 1/0141; G08G 1/096775

See application file for complete search history.

(56) References Cited

U.S. PATENT DOCUMENTS

2002/0082806 A1* 6/2002 Kaub ..... G08G 1/0104 702/182
2006/0095199 A1* 5/2006 Lagassey ..... G07C 5/008 701/117
2015/0032289 A1* 1/2015 Lotz ..... G08G 1/0112 701/1
2016/0076207 A1* 3/2016 Moran ..... E01F 9/30 340/905
2017/0262790 A1* 9/2017 Khasis ..... G05D 1/0287
2017/0352262 A1* 12/2017 Xu ..... G08G 1/0112
2018/0032082 A1* 2/2018 Shalev-Shwartz ..... B60W 30/0953
2018/0216952 A1* 8/2018 Krumm ..... G01C 21/3492

(Continued)

OTHER PUBLICATIONS

Abdel-Aty et al., Predicting freeway crashes from loop detector data by matched case-control logistic regression, Journal of the Transportation Research Board, No. 1897, pp. 88-95, 2004.

(Continued)

*Primary Examiner* — Santiago Garcia

(74) *Attorney, Agent, or Firm* — Theodore M. Magee; Westman, Champlin & Koehler, P.A.

(57) ABSTRACT

A method includes using sensors to collect information about vehicles on a road and determining a plurality of crash probabilities based on the collected information. Each crash probability indicates a probability of a vehicular crash on the road at a respective point in time. The plurality of crash probabilities is averaged to form an average crash probability and the average crash probability is used to determine when to provide a message to a controller of a vehicle.

17 Claims, 9 Drawing Sheets

(56) References Cited

U.S. PATENT DOCUMENTS

| | | | | |
|---|---|---|---|---|
| 2018/0362037 | A1* | 12/2018 | Ishiwatari | B60W 30/0956 |
| 2018/0365987 | A1* | 12/2018 | Li | G08G 1/0133 |
| 2019/0272747 | A1* | 9/2019 | Raamot | G08G 1/0129 |
| 2019/0279502 | A1* | 9/2019 | Fowe | G08G 1/0967 |

OTHER PUBLICATIONS

Abdel-Aty et al., Calibrating a real-time traffic crash-prediction model using archived weather and ITS traffic data, IEEE Transactions on Intelligent Transportation Systems, vol. 7, No. 2, pp. 167-174, 2006.

ARTBA Work zone safety consortium, Innovative end-of-queue warning system reduces crashes up to 45%, 2 pages, 2015.

Bertini et al., Dynamics of variable speed limit system surrounding bottleneck on German autobahn, Journal of the Transportation Research Board, No. 1978, pp. 149-159, 2006.

Caliendo et al., A crash-prediction model for multilane roads, Accident Analysis and Prevention vol. 39, pp. 657-670, 2007.

Comert et al., Queue length estimation from probe vehicle location and the impacts of sample size, European Journal of Operational Research No. 197, pp. 196-202, 2009.

Delta Highway Queue Warning System Evaluation—Final Technical Memorandum, http://www.kittelson.com/projects/intelligent-transportation-systems-its-statewide-evaluations, 14 pages, Accessed Jul. 19, 2016.

Early Estimate of Motor Vehicle Traffic Fatalities in 2014, https://crashstats.nhtsa.dot.gov/Api/Public/ViewPublication/812160, 3 pages, 2015.

Elefteriadou et al., Probabilistic nature of breakdown at freeway merge junctions, Transportation Research Record 1484, pp. 80-89, 1995.

Ghosh-Dastidar et al., Neural network-wavelet microsimulation model for delay and queue length estimation at freeway work zones, Journal of Transportation Engineering, vol. 132, No. 4, pp. 331-341, 2006.

Golob et al., Relationships among urban freeway accidents, traffic flow, weather and lighting conditions, Journal of Transportation Engineering, vol. 129, No. 4, 11 pages, 2003.

Harder, Investigating the effectiveness of intelligent lane control signals on driver behavior, Final Report, 72 pages, 2012.

Hourdakis et al., Deployment of wireless mobile detection and surveillance for data-intensive applications, Journal of Transportation Research Board No. 1900, pp. 140-148, 2004.

Hourdos et al., Real-time detection of crash-prone conditions at freeway high-crash locations, Journal of Transportation Research Board No. 1968, pp. 83-91, 2006.

Hourdos, Crash prone traffic flow dynamics: identification and real-time detection, dissertation, University of Minnesota, 336 pages, 2005.

Hourdos et al., Accident prevention based on automatic detection of accident prone traffic conditions: phase I, Intelligent Transportation Systems, Final Report, 169 pages, 2008.

Hourdos et al., Development of real-time traffic adaptive crash reduction measures for the Westbound I-94/35W commons section, Intelligent Transportation Systems, Final Report, 119 pages, 2008.

Jones et al., The measurement of acceleration noise-A traffic parameter, Operations Research, vol. 10, No. 6, pp. 745-763, 1962.

Khan, Intelligent infrastructure-based queue-end warning system for avoiding rear impacts, IET Intelligent Transportation Systems, vol. 1, No. 2, pp. 138-143, 2007.

Kopelias et al., Urban freeway crash analysis, geometric, operational, and weather effects on crash number and severity, Transportation Research Board No. 2015, pp. 123-131, 2007.

Lee et al., Real-time crash prediction model for the application to crash prevention in freeway traffic, Paper No. 03-2749, Journal of Transportation Research Board No. 1840, 21 pages, 2003.

MacCarley, Methods and metrics for evaluation of an automated real-time driver warning system, Journal of the Transportation Research Board, No. 1937, pp. 87-95, 2005.

Mahmassani et al., Concept development and needs identification for intelligent network flow optimization (INFLOW)—Assessement of relevant prior and ongoing research, USDOT ITS Joint Program Office, 94 pages, 2012.

Montella et al., Crash prediction models for rural motorways, Journal of the Transportation Board, No. 2083, pp. 180-189, 2008.

Pande et al., Assessment of freeway traffic parameters leading to lane-change related collisions, Accident Analysis and Prevention 38, pp. 936-948, 2006.

Zheng et al., Impact of traffic oscillations on freeway crash occurrences, Accident Analysis and Prevention 42(2), pp. 626-636, 2010.

* cited by examiner

FREEWAY QUEUE WARNING SYSTEM

CROSS-REFERENCE TO RELATED APPLICATION

The present application is based on and claims the benefit of U.S. provisional patent application Ser. No. 62/512,999, filed May 31, 2017, the content of which is hereby incorporated by reference in its entirety.

This invention was made with State of Minnesota support under 99008, WO #154 awarded by Minnesota. The State of Minnesota has certain rights in this invention.

BACKGROUND

Sudden changes in traffic conditions often result in rear-end crashes. However, it is impossible for drivers to know when the conditions on the roadway in front of them have become crash-prone.

The discussion above is merely provided for general background information and is not intended to be used as an aid in determining the scope of the claimed subject matter. The claimed subject matter is not limited to implementations that solve any or all disadvantages noted in the background.

SUMMARY

A method includes using sensors to collect information about vehicles on a road and determining a plurality of crash probabilities based on the collected information. Each crash probability indicates a probability of a vehicular crash on the road at a respective point in time. The plurality of crash probabilities is averaged to form an average crash probability and the average crash probability is used to determine when to provide a message to a controller of a vehicle.

In accordance with a further embodiment, a system includes at least one traffic sensor capable of providing a sensor signal indicative of traffic on a road and a processor. The processor receives the sensor signal provided by the at least one traffic sensor and uses the sensor signal to determine a crash probability that indicates a likelihood of a crash occurring. The processor also uses the crash probability and a current velocity of at least one vehicle to determine whether to notify a controller of a vehicle that crash-prone conditions are present on the road.

In accordance with a still further embodiment, a method includes determining a sequence of traffic conditions on a road based on a signal from at least one traffic sensor and using the sequence of traffic conditions to select a function for computing a crash probability. The crash probability is then used to determine whether to provide a message to a controller of a vehicle on the road.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
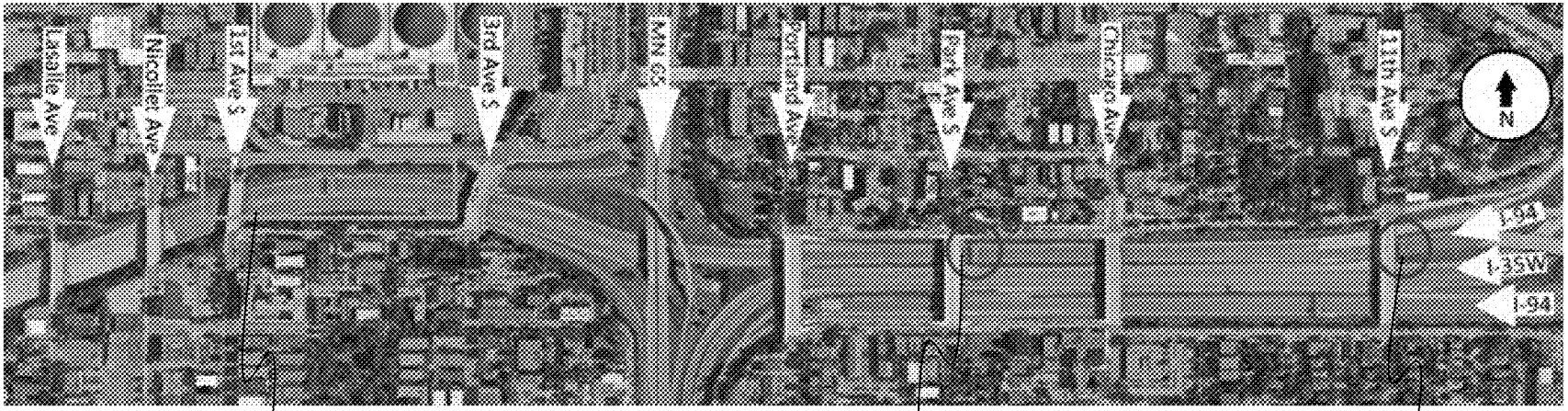
FIG. 1 provides a plan view of a section of freeway on which systems of the various embodiments are implemented.

In the description below, a system for providing messages to controllers of vehicles is described. The controllers of vehicles can include a human driver in the vehicle, a human driver who is remotely controlling the vehicle, an onboard computing system that is located in the vehicle and controls movement of the vehicle, a remote computing system that is located remotely from the vehicle but still controls movement of the vehicle, or any combination of these controllers. A message is considered to be provided to the controller of the vehicle when it is transmitted so that the controller or at least one of the controllers can receive and understand the message. For human drivers, a message is provided to the driver if it is displayed on a road sign, is displayed on a monitor or mobile device where the driver is located, or is announced on an audio system where the driver is located. For computing systems, the message is considered provided to the controller of the vehicle when data representing the message is addressed to the computing system and is sent either directly or through one or more networks to the computing system.

The various embodiments described herein provide a Queue Warning system (QWARN) that is capable of detecting dangerous traffic conditions, i.e. crash-prone conditions, on roads and delivering warning messages to controllers of vehicles, in order to increase their alertness to these traffic conditions and ultimately reduce crash frequency. The vehicle controllers can be human drivers, electronic controllers located within a self-driving vehicle, or electronic controllers or human drivers located in a remote location from the vehicle. The embodiments approach the topic from the quantification of traffic flow to the multi-layer system design along with different approaches including the traffic assessment modeling and the development of control algorithms. The embodiments also introduce a new approach in evaluating the proposed system by measuring the efficiency of the warning that overcomes the limit of traditional evaluation indexes like false alarm rate.

1 Example Site and Available Data

In accordance with some embodiments, conditions are observed and measured before, during, and shortly after an actual event. This translates to continuous monitoring and data collection at a location that maximizes the probability of recording crashes.

In the Minneapolis-Saint Paul Metropolitan Area (Twin Cities), Interstate 94 (I-94) connects these two major cities, and it is the major freeway corridor connecting the two banks of the Mississippi River in the region. One embodiment was implemented along a length of 1.7 miles on I-94 westbound near Downtown Minneapolis. This segment of I-94 is near the exit of I-35W, the west branch of Interstate 35 that goes through Minneapolis. Being near the downtown results in a large traffic volume merging in and out these two freeways. Such large volume and merging often destabilizes traffic on this freeway segment, resulting in rear-end crashes. These dangerous traffic conditions often produce shockwaves where drivers need to reduce their speed in a short time and space. According to MnDOT records, this segment had the highest crash rate in the entire freeway system, as high as 4.81 crashes per million vehicle miles. An equivalent to approximately a crash every two days. Fatalities and severe injuries are very rare since the prevailing speed during Crash-Prone Conditions (CPCs) is relatively low. The majority of crashes result only in property damage.

The crash-prone section runs parallel to I-35W, and short ramps allow transfers between freeways (FIG. 1). The freeways and cross streets are labeled. Changeable message boards that convey messages to drivers are located in areas denoted by the circles 102 and 104 and a high-volume on-ramp is enclosed by a rectangle 106. The site includes two entrance and three exit ramps and averages three lanes, with 3,000-foot auxiliary lanes in each of the two weaving areas. Weaving is excessive where high volumes enter from the ramp outlined by rectangle 106 in FIG. 1, which combines traffic from I-35W, MN 65, and the downtown business center to the north. In addition to the traffic volume entering the rightmost lane from the ramp, many drivers on I-94 merge right in order to be in or near the rightmost lane in order to exit via two ramps downstream of Lasalle Ave. During periods of congestion, shockwaves generally originate when vehicles merge onto I-94 from the aforementioned ramp and cause vehicles in the rightmost lane to brake. If conditions are sufficiently dense, one vehicle entering from the ramp can initiate a chain reaction of vehicles braking that grows into a shockwave that causes increasingly intense braking as it moves upstream. Due a vertical and horizontal curve, vehicles between Chicago Ave and Portland Ave have limited forward sight distance. Drivers' inability to see a shockwave approaching forces them to depend heavily on their reaction time to avoid rear-ending the vehicle ahead of them.

In an attempt to reduce the number of shockwaves, a double white line was extended by 1000 feet from the point where the ramp joins I-94 to the region between 1st Ave S and Nicollet Ave. The intent was to prohibit merging for another 1000 feet in order to move the merging zone to an area with longer forward sight distances and make it easier for drivers on the ramp to match the speed of traffic on I-94. This solution, although it reduced the severity of the crashes, it did not reduce their frequency.

Initially, for the purposes of projects related to intelligent transportation systems (ITS), a traffic detection and surveillance laboratory was established in 2002 as part of the Minnesota Traffic Observatory (MTO) of the University of Minnesota. Hourdakis, J., Michalopoulos, P. G., and Morris, T. *Deployment of Wireless Mobile Detection and Surveillance for Data-Intensive Applications*. A report in Transportation Research Record: Journal of the Transportation Research Board, No. 1900, Transportation Research Board of the National Academies, Washington, D.C., 2004, pp. 140-148, provides details of the site instrumentation and capabilities and is hereby incorporated by reference. Because the site is close to the downtown area, nearby high-rise buildings allowed the installation of several cameras and machine vision sensors overlooking the roadway. While most of the sensors are not utilized by the queue-warning system, they provide the means of collecting detailed observations and determining ground truth.

As shown in Table 1, different types of data are used in the embodiments. Individual vehicle measurements of speed and time headway were used for the operation of the system and aggregated traffic speed data from loop detectors serve for system adjustment and system evaluation. In order to collect the necessary individual vehicle data cost-effectively and unobtrusively, machine vision detectors (MVDs) were utilized. Due to the high concentration of conflict events at the test site, only two such sensors stations were necessary, one placed at the location of the most frequent crashes and the second approximately 750 feet downstream. The two stations were deployed between 3rd Ave and MN 65 and between MN 65 and Portland Ave.

Embodiments also utilize in-pavement loop detectors to provide 30 second volume and occupancy data to provide additional information for the system adjustment from policy makers. Five surveillance cameras were also employed: four atop a high-rise building to capture vehicle conflict events between 3rd Ave and Chicago Ave on video and one atop a pole to capture live video of the MnDOT changeable message boards at the 11th Ave gantry (circle 102 in FIG. 1). Video from all five cameras was captured and saved digitally from 9 a.m. to 8 p.m. every day. Vehicle data from the loop detector is collected, 24 hours a day, 7 days a week whereas the individual vehicle measurements were only collected between 7 a.m. and 8 p.m. each day. Traffic event data extracted from these surveillance videos were used to measure the performance of the proposed system in a real-world context.

TABLE 1

Summary of data types and purpose

| Data | Type | Source | Purpose |
|---|---|---|---|
| Aggregated Traffic Data | Real-Time | Loop Detector | Additional input for system adjustment |
| Aggregated Traffic Data | Historical | Loop Detector | Developing of system evaluation methodology |
| Individual Vehicle Measurements | Real-Time | MVD | The major input of the system |
| Individual Vehicle Measurements | Historical | MVD | Algorithm and system Design and development |
| Traffic Event Data | Historical | Video | Developing of system evaluation methodology, algorithm and system design and development |

2 Traffic Measurements and Metrics

Figure 2:
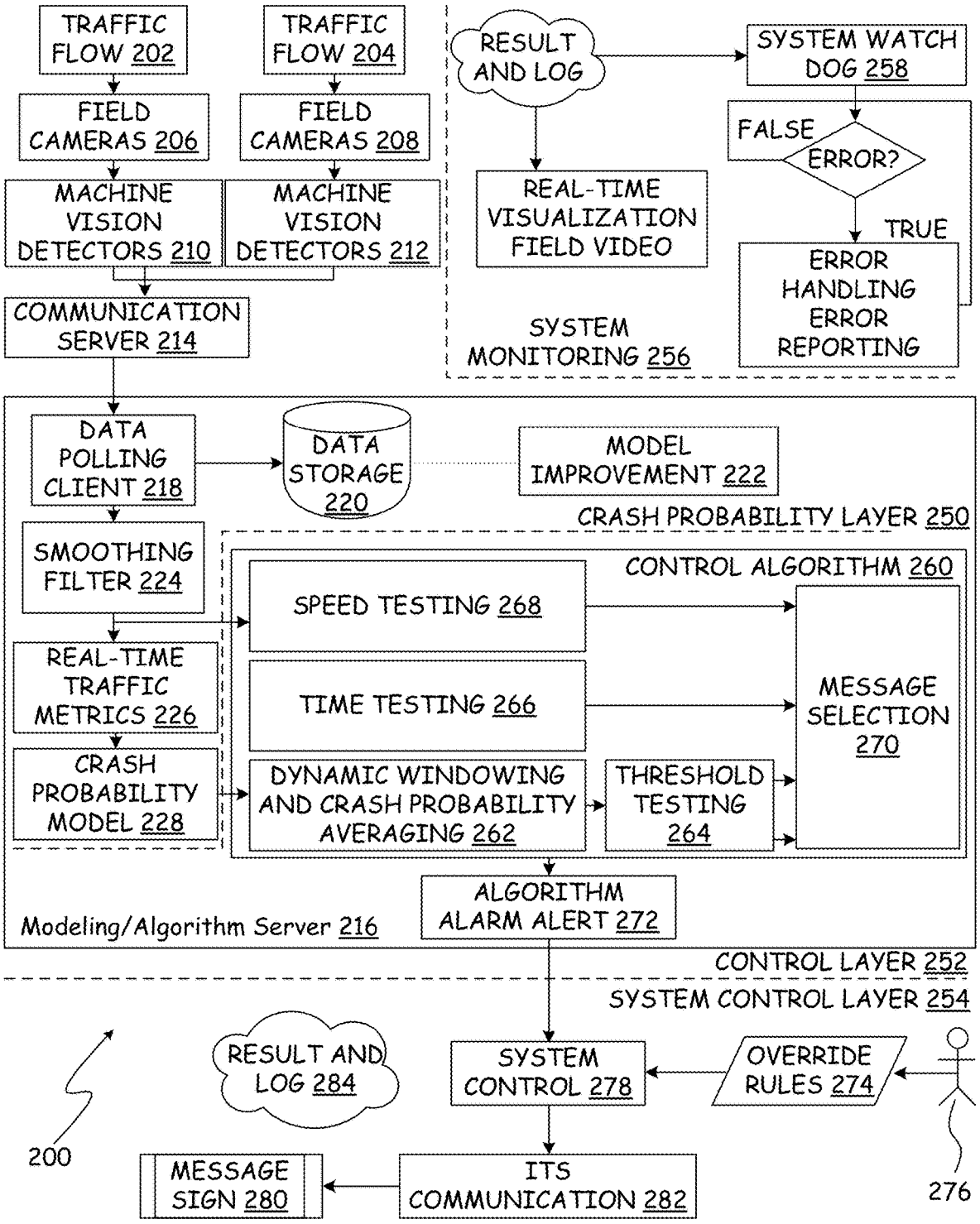
FIG. 2 provides a combination flow diagram and block diagram of a method and system for providing messages to controllers of vehicles in accordance with one embodiment.

FIG. 2 provides a combined block diagram and flow diagram of a system and method 200 in accordance with one embodiment. In FIG. 2, images of traffic flow at two different locations 202 and 204 are captured by field cameras 206 and 208. The images captured by cameras 206 and 208 are provided to machine vision detectors 210 and 212, which use the images to compute individual vehicle speed and headway. Although not shown, loop detectors also form part of system 200. The output of machine vision detectors 210 and 212 and the loop detectors passes through one or more communication servers 214 and are pulled from communication servers 214 by a data polling client 218 on a modeling/algorithm server 216. The data is stored in data storage 220 of server 216 for use by a model improvement process 222.

Individual Vehicle Speed Noise Reduction

All sensors inherently have error and noise in their measurements. In the past, such noise caused surges in crash-likelihood calculations and compromised the accuracy of various crash models. In order to reduce the noise in a time series, filtering techniques such as the one proposed by Hourdos, J. (2005) *Crash prone traffic flow dynamics: Identification and real-time detection*. Ph.D. dissertation, University of Minnesota, are employed in some embodiments using a smoothing filter 224.

To perform a time series analysis and noise removal, the original unstructured speed data is translated into a 1-second-speed time series using interpolation. Two different interpolation methods, linear interpolation and spline interpolation, were considered as candidates and tested in a preliminary study by the present inventors. Linear interpolation consists of simply connecting the data points with straight lines while spline interpolation uses a single, continuous curve to connect all the points. When comparing these two methods, spline interpolation was found to be problematic as the requirement that the data points be connected with a smooth curve produced interpolated speeds that were well outside of the normal range thereby introducing additional error and noise. Because of this, linear interpolation is used in many of the current embodiments. In accordance with one embodiment, of the several different filters that Hourdos designed and tested on their ability to remove impulse noise, his Digital FIR Hamming filter was selected to perform the noise reduction for the system.

After filtering, the data become another time series with lower noise. Given that the time headways between vehicles are as informative as their speeds, the dataset needs to be returned to its original form before the traffic metrics are calculated. A reverse interpolation method finding the filtered speeds at the times of the original data points is implemented.

The filtered data is then provided to a real-time traffic metrics calculator 226 to calculate traffic metrics from the data. Several metrics are calculated using individual vehicle information such as speed and headway in order to quantitatively describe traffic conditions. As individual vehicle measurements hold the benefit of having much detailed information in high resolution, they also carry large amount of stochastic noise. This fact brings a paradox that aggregation can reduce the impact of noise but also result in loss of detailed information while increase the resolution may bring more noise. Traditionally, individual vehicle measurements are aggregated in time to produce averages. While the aggregated data has less noise, it can no longer describe both the temporal and spatial nature of different traffic flow conditions.

In order to obtain elaborate information without much noise, a multi-metric approach is utilized in the various embodiments, which aggregates the data into different traffic metrics. This approach reduces the impact of noise by aggregating individual vehicle measurements over space and time while the combination of different metrics attempts to compensate for the loss of information during the aggregation and quantify more characteristics of the traffic flow. To that end, Hourdos, J., Garg, V., Michalopoulos, P., & Davis, G. (2006). *Real-Time Detection of Crash-Prone Conditions at Freeway High-Crash Locations*. Transportation Research Record, 1968(1), 83-91. doi: 10.3141/1968-10, proposed a series of traffic metrics derived from individual vehicle measurements, both temporal and spatial, to detect crash-prone conditions in freeway traffic. Variations of metrics were also introduced to reflect aggregation over time and space. These metrics include average speed, coefficient of variation of speed, traffic pressure, kinetic energy, coefficient of variation of time headway, coefficient of variation of space headway, acceleration noise, mean velocity gradient, quality of flow index, and a number of heuristic metrics calculated with data from multiple detectors.

Generally, a moving average window approach was utilized in the various embodiments to perform the translation from individual vehicle measurements to these metrics. With a sequence of individual vehicle speeds, the entries needed for a specific metric will be selected by the size and time shift of such moving window. Window size represents the number of vehicles in a window. Prior time shift determines the location of the moving window and it decides the time distance between the last vehicle in the window with the concept of "current time" in a real time system. In the various embodiments, window sizes were chosen from the set {15,30,40,50,60,70,80,100,110,120} in vehicles and prior time shifts were selected from the set {10,30,60,120, 180,240,300} in seconds. The variations in temporal and spatial metrics that follow will be denoted in the form Metric-Location-Lane-Window size-Window end time. For example, AvgSp-Down-R-15-30 denotes the average speed among 15 vehicles on the right lane of the downstream station at least 30 seconds ago.

2.1 Temporal Metrics

The following are the definitions of a few of the metrics used in the estimation of the crash probability.

2.1.1 Average Speed

Average speed is a common and informative statistic and helps reduce stochastic noise.

2.1.2 Coefficient of Variation of Speed (CVS)

In addition to averaging, standard deviation is also a popular way to measure data dispersion. The coefficient of variation, also called relative standard deviation, standardizes the actual standard deviation by its sample mean. The CVS is the product of the standard deviation and the mean value of the speed. As its definition implies, a higher value of the coefficient of variation of speed means higher variability in the speed data.

2.1.3 Coefficient of Variation of Time Headway (CVTH)

The time headway (TH) between vehicles is an important metric that describes safety and level of service. TH calculation requires individual vehicle arrival times at a point and is simply the difference between the arrival times of two successive vehicles. For the purposes of this research, the actual time headways are not as important as the magnitudes and rates of their change, so the chosen metric is the CV of TH in a group of n vehicles.

2.2 Spatial Metrics 2.2.1 Density

Density (k) is defined as the number of vehicles per unit length. It is an important characteristic of traffic flow in many models describing its relationship with speed. There are several different models that measure density such as a linear model by Greenshields, a log model by Greenberg, an exponential model by Underwood, and many others. In the present embodiments, density is not used directly but rather as a component in the calculations of other traffic metrics such as traffic pressure and kinetic energy.

2.2.2 Acceleration Noise

Acceleration noise is a measure of the smoothness of the traffic flow based on an estimation of individual acceleration dispersion. Three factors are highly related to the value of acceleration noise: driver, road and traffic condition. The calculation of the acceleration noise in the various embodiments follows the approximation proposed by Jones, Trevor R., and Potts Renfrey B. "*The Measurement of Acceleration Noise-A Traffic Parameter*." Operations Research 10.6 (1962): 745-63. Web.

2.2.3 Mean Velocity Gradient

In order to differentiate between different traffic conditions with similar acceleration noise, such as slow, congested traffic versus fast traffic inside a shockwave, Helly, W., and Baker, P. G., (1965). "*Acceleration noise in a congested signalized environment*." Vehicular Traffic Science. Proceedings of the Third International Symposium on the Theory of Traffic Flow. American Elsevier, New York. pp. 55-61, proposed another measurement, the mean velocity gradient, described by Equation 1.

$$MVG = \frac{\Sigma_{i=1}^{N}(MVG_i)}{N} \qquad 1$$

$$MVG_i = \frac{(AN)_i}{\overline{u_i}}$$

Where

MVG: Average Mean Velocity $MVG_i$: Mean Velocity Gradient of vehicle i

N: Total number of vehicles in a hypothetical mile $(AN)_i$: Acceleration Noise $\overline{u}_i$: Average speed (mean velocity) of vehicle i 2.2.4 Quality of Flow Index The quality of flow index proposed by Greenshields, B. D. (1961) "*Quality of Traffic Flow, Quality and Theory of Traffic Flow*." Symposium, Bureau of Highway Traffic, Yale University, New Haven, Conn. pp. 3-40, provides a quantitative metric to describe the safety of the traffic conditions on a given road based on the number of speed changes and their frequency (Equation 2).

$$QFI = \frac{\Sigma_{i=1}^{N} QFI_i}{N} \qquad 2$$

$$QFI_i = \frac{\overline{ku}}{\Delta u}\sqrt{f}$$

Where

QFI: Average Quality of Flow Index $QFI_i$: Quality of Flow Index of Vehicle i

N: Total number of vehicles in a hypothetical mile $\overline{u}$: Average speed $\Delta u$: Absolute sums of speed changes in a mile f: Number of speed changes in a mile k: Constant of 1000 when speed unit is mph and the length of the section is one mile.

2.2.5 Traffic Pressure

Traffic pressure (TP) was designed to measure the smoothness of traffic flow. It is defined as the product of speed variance and density Phillips, W. F., (1979). "*A kinetic model for traffic flow with continuum implications*". Transportation Planning and Technology 5, 131-138, as seen in Equation 3a. As discussed previously, a higher density is generally associated with a lower average speed. When both the density and the variance of speed are high, it may indicate a "stop-and-go" traffic that could be dangerous and crash prone.

$$TP=\sigma_s^2 \times k \qquad 3a$$

Where

TP: Traffic Pressure $\sigma_s^2$: Speed variance k: Density 2.2.6 Kinetic Energy (KE)

Kinetic Energy is a familiar quantity in the world of physics that represents the energy of a moving object. This measurement can also be modified to quantify the energy stored in the traffic flow. In the context of traffic flow, kinetic energy measures the energy in the motion of the traffic stream.

Similar to the kinetic energy in physics, according to energy conservation law, within the given traffic system the total amount of energy will not change but can change its form. Drew, Donald. R, (1968) "*Traffic Flow Control and Theory*", McGraw Hill, described the antithesis of kinetic energy as internal energy that is erratic motion due to geometrics and vehicle interactions and corresponds to an earlier description of Acceleration Noise. Please note that the Kinetic Energy in the various embodiments is for traffic flow and it is different from the kinetic energy of a moving object, which means it is not dependent on the mass of vehicles but instead on the density of the traffic stream. The formulation of KE is described in equation 3b.

$$KE=ak(\overline{u})^2 \qquad 3b$$

Where a: kinetic energy correction parameter, a dimensionless constant, here is 1 k: density of the traffic stream $\overline{u}$: average speed of the stream 2.3 Heuristic Metrics 2.3.1 Up/Down Speed Difference The up/down speed difference is the difference between the maximum vehicle speed at the upstream sensor and the minimum vehicle speed at the downstream sensor. Its purpose is to measure the travel behavior of a shockwave. For example, when traffic is smooth without shockwaves, the up/down speed difference should be small. When a shockwave has reached the downstream sensor, but has not yet reached the upstream sensor, there should be a lower speed downstream than upstream thus resulting in a high up/down speed difference. A positive Up/Down Speed Difference indicates that the maximum speed of upstream is higher than the minimum speed of downstream. On the other hand, a negative sign of Up/Down speed difference indicates that the maximum speed of upstream is lower than the minimum speed of downstream. The latter case may happen when upstream is in congestion and downstream traffic already recovered from congestion.

2.3.2 Right/Middle Lane Speed Difference

As the name suggests, this metric is the difference in speeds between the right lane and the middle lane. When the traffic on the right lane is significantly slower than that on the middle lane, lane changes become more dangerous as they require drivers to divert their attention from the traffic ahead and search for a gap in their mirrors. This increases their reaction time and can be dangerous when shockwaves approach.

2.3.3 Max/Min Speed Difference

This metric measures the difference between the maximum speed and minimum speed at a sensor location. When a shockwave hits a location, in a relatively short number of vehicles, the speeds tend to fluctuate and drop and results in a high Max/Min Speed Difference. Such a high value is usually observed in the occurrence of traffic oscillations and crashes.

2.4

3 Crash Probability Model

Given the described metrics and their variants as well as the selected digital filter, a crash probability model 228 is produced. In accordance with one embodiment, the model is based on a fitted logistic regression model such as the model described by Hourdos, J. (2005) *Crash prone traffic flow dynamics: Identification and real-time detection*. Ph.D. dissertation, University of Minnesota, which is incorporated herein, to reflect the likelihood of a crash.

The parameters of the functions used to compute the crash probability can be determined from a set of training data and thereafter remain fixed or can be continuously or periodically updated using machine learning. In accordance with one embodiment, the crash probability is calculated using an artificial neural network which receives the various road sensor features described above as well as indicators of when a crash is/was present on the road. After being initially trained, the artificial neural network continues to adapt its internal weights based on new input features and crash indications. This machine learning allows the system to adapt to different roads, different road conditions, and different traffic patterns. Although an artificial neural network has been discussed, other machine learning techniques can be used including other supervised and unsupervised learning techniques.

In accordance with one embodiment, the crash probability for a time point is computed by selecting a crash probability function based on a sequence of traffic states that have recently occurred. These embodiments are based on the inventor's recognition that the crash probability functions change depending on what traffic states have previously occurred on the road.

Figure 3:
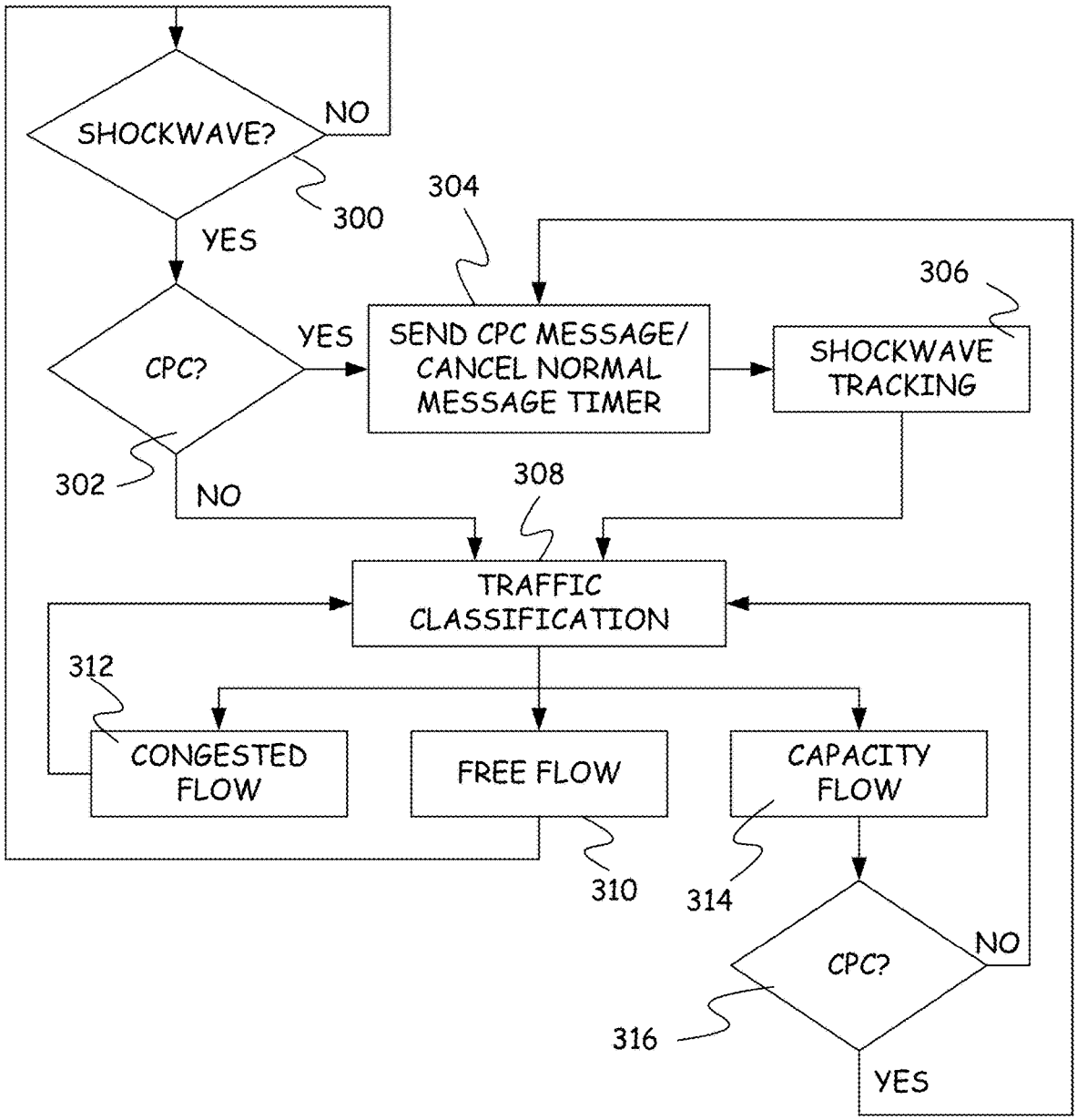
FIG. 3 provides a flow diagram of a method for determining when to send messages to a controller in accordance with one embodiment.

FIG. 3 shows a flow diagram for monitoring traffic states, selecting crash probability functions based on those traffic states and sending message to controllers of vehicles based on the crash probabilities. In step 300, traffic is in a free flow state and the system is monitoring the traffic for a shockwave. In the free flow state, traffic is moving in a stable state such that small disturbances, such as brief vehicle braking or lane changes, do not cause a significant change in the flow rate of the collection of vehicles on the road. When a vehicle suddenly brakes while in the free flow state, a shockwave moves through the traffic, triggering crash-prone conditions detection 302. Crash-prone conditions detection 302 selects a crash probability function that is associated with having free flow traffic just before a shockwave was detected and uses this selected crash probability function to determine whether crash-prone conditions are present on the road as discussed further below.

If crash-prone conditions are present on the road, a message is sent to the controller(s) of the vehicle to indicate the crash-prone conditions at step 304. If a message of crash-prone conditions had previously been sent and a timer has been started for sending a normal conditions message, the timer is canceled at step 304.

At step 306, a parallel subroutine is started that tracks the current shockwave and monitors the traffic for additional shockwaves. When no shockwaves are present in the traffic, the parallel subroutine starts a timer for sending the normal conditions message.

After the parallel shockwave detection subroutine is started at step 306 and while it continues to run, or if no crash-prone conditions are detected at step 302, the current state of the traffic is classified at step 308. The current state of the traffic can be classified as free flow 310, congested flow 312 or capacity flow 314. If the traffic is classified as congested flow, the process returns to step 308 to collect new traffic data and reclassify the traffic based on the new data. If the traffic is classified as free flow, the process returns to step 300 to await a shockwave in the traffic.

If the traffic is classified as capacity flow 314, the process continues with crash-prone conditions detection 316. In capacity flow 314, traffic is moving in a metastable state where vehicles are closer together and it is more likely that a small disturbance will cause the flow rate to suddenly decrease, forcing the traffic into congestion state 312. Because capacity flow 314 is different from free flow 310, crash-prone conditions detection 316 uses different crash probability functions from crash-prone conditions detection 302. In particular, crash-prone conditions detection 316 selects a crash probability function that is associated with having capacity flow traffic before a crash was detected and uses this selected crash probability function to determine whether crash-prone conditions are present on the road.

If crash-prone conditions are detected at step 316 the process returns to step 304 to either send a new crash-prone conditions message or to cancel a timer for sending a normal conditions message. If crash-prone conditions are not present, the process returns to step 308 to collect new traffic data and reclassify the traffic based on the new data.

Although the embodiments above describe selecting the crash probability function based on the current state of the traffic, in other embodiments, sequences of traffic flow states are used to select the crash probability function. As recognized by the present inventors, the probability of a crash when traffic first enters capacity flow state 314 is different from the probability of a crash when traffic has entered capacity flow state 314, returned to free flow state 310 and then returned to capacity flow state 314. In particular, the combination of features that predict a crash are different in the two situations and as a result, the probability functions used to predict crashes are different. Similarly, once traffic has entered congestion state 312, the crash probability functions are altered when traffic returns to free flow state 310 or capacity flow state 314 because drivers adjust their driving to expect a future congestion state 312.

In such embodiments, a sequence of past traffic states is maintained in memory and is updated with each change in the traffic state. The sequence of past traffic states is used to select a crash probability function from a set of crash probability functions to compute a crash probability for a current time point. The parameters of the various crash probability functions may be set based on previous training data and thereafter remain fixed or may be adaptively changed over time using machine learning.

3.1 System Architecture

This section presents the system architecture in accordance with one embodiment. As shown in FIG. 2, the system follows a three-layer design. The Crash Probability layer 250 collects real-time individual vehicle measurements and processes them to remove noise. The filtered data then pass to the crash-probability model 228 to assess the likelihood of a crash. This crash likelihood along with additional traffic information such as speeds and headways are passed to the second layer, the Control layer 252. In Control layer 252, a control algorithm 260 decides if a warning message should be generated by forming average crash probabilities over various sized windows of time, comparing the average crash probabilities to certain thresholds and using the comparison together with real-time traffic conditions to determine what message if any should be provided to a controller of a vehicle, such as a driver. The message, if any, is passed to a third layer: System Control Layer 254, in which requirements from policy makers are applied to modify the result before delivering the message to the controller of the vehicle. A system monitor 256 monitors crash probability layer 250 and control layer 252 to determine if both layers are operating and if any errors have occurred. If a process in either of the layers stops operating, a system watchdog application 258 in system monitor 256 attempts to restart the process and if the restart does not succeed, will send a message to a person responsible for the system.

3.2 Control Algorithm

This section describes the second layer of the system, control layer 252. Control algorithm 260 of control layer 252 is developed to determine when to start and stop warning messages. In accordance with one embodiment, the inputs in the algorithm are a time series of crash probabilities from crash probability model 228 and the filtered vehicle speeds from smoothing filter 224. A moving median filter, or average filter, is applied to the crash probabilities to reduce noise and outliers. A dynamic average window methodology is used to calculate the adjusted crash probability for real-time traffic conditions. Based on this adjusted crash probability, user-defined thresholds, and the result of a speed test, the decision of whether to send a message to the controller of the vehicle is made by the system. Once a message has been sent to the controller indicating crash-prone conditions, it remains active for a minimum period of time regardless of whether the average crash probability drops below the threshold. This assures that the crash-prone conditions message will remain active throughout the trajectory of the shockwave. In accordance with one embodiment, each subsequent crash-prone conditions message renews the minimum active period of time for the message.

3.3 Control Logic

As noted above, the instantaneous crash probability tends to be noisy. As a result, simply comparing the instantaneous crash probability to a threshold to determine whether to issue a crash-prone conditions message or a normal conditions message results in the crash-prone conditions message being flashed to the controller of the vehicle even when conditions are crash-prone only for a brief instant and results in the crash-prone conditions message being changed back to the normal conditions message too quickly when the instantaneous crash probability drops back below the threshold.

In accordance with the various embodiments, four techniques are used to reduce the effects of having a noisy instantaneous crash probability. First, instead of using an instantaneous crash probability directly, an average or moving median filter of crash probabilities is used. This smooths the crash probability and reduces the effects of sudden spikes in the crash probability. Second, the number of time points used to calculate the average crash probability varies as a function of how close the current instantaneous crash probability is to a threshold that the average probability is to be compared against. Third, different thresholds for changing messages are used depending on the last message sent. In accordance with one embodiment, a two-threshold approach is employed to determine whether the crash likelihood indicates crash-prone conditions. One threshold is used to determine when to send the message indicating crash-prone conditions and a second threshold is used to determine when to revert back to the normal conditions message. Fourth, additional tests in addition to the average crash probability test are used to determine when to change the message sent to the drivers including tests based on the velocity of vehicles on the road and a time period since the message was last changed. In accordance with one embodiment once a crash-prone conditions message is sent, the message will remain active for a minimum time period, currently one minute.

The control logic of control algorithm 260 is:

$$\text{Greater}(\overline{p_t}, \lambda_1)\text{^}\text{SpeedTest}(v_{tb}) \rightarrow \text{AlarmOn} \tag{4}$$

$$\text{AlarmOn}\text{^}\text{Greater}(\lambda_2, p_t)\text{^}\text{TimeCheck}(t) \rightarrow \text{AlarmOff}$$

$$\text{Greater}(\overline{p_t}, \lambda_1) = \begin{cases} \text{true} & \overline{p_t} \geq \lambda_1 \\ \text{false} & \overline{p_t} < \lambda_1 \end{cases}$$

$$\text{Greater}(\lambda_2, \overline{p_t}) = \begin{cases} \text{true} & \lambda_2 \geq \overline{p_t} \\ \text{false} & \lambda_2 < \overline{p_t} \end{cases}$$

$$\text{SpeedTest}(v_{tb}) = \begin{cases} \text{true} & v_{tb} \leq u_1 \\ \text{false} & v_{tb} > u_1 \end{cases}$$

$$\text{TimeCheck}(t) = \begin{cases} \text{true} & t - t_0 > \Delta t \\ \text{false} & t - t_0 \leq \Delta t \end{cases}$$

Where $u_1$: test speed, default is 45 mph. (mph)

$t_0$: last time in the past when the system changed to an AlarmOn state $\lambda_1$: Starting Threshold $\lambda_2$: Ending Threshold $v_{tb}$: Current Downstream Speed (mph)

$\overline{p_t}$: Adjusted Crash Probability $$\overline{p}_t = \frac{1}{n} \sum_{i=t-n+1}^{t} p_i \tag{5}$$

$$n = \begin{cases} f(\overline{p_t}, \lambda_1) & \overline{p_t} \geq \lambda_1 \\ g(\overline{p_t}, \lambda_1, \lambda_2) & \lambda_2 \leq \overline{p_t} < \lambda_1 \\ h(\overline{p_t}) & \overline{p_t} < \lambda_2 \end{cases}$$

AlarmOn is a message state in which the last message sent to the controller of a vehicle was a crash-prone conditions message and AlarmOff is a message state in which the last message sent to the controller of a vehicle was a normal conditions message. The arrows in equation 4 represent a transition to the respective message states when the Boolean equation on the left-hand-side of the equations is true, and the message states have a Boolean value of true when the system is in those states and a Boolean value of false when the system is not in those states.

The value n is the size of the dynamic window used to average the crash probability. Using a dynamic window size makes the algorithm more sensitive to crash-prone conditions and reduces the probability of false alarms caused by noise in the measurement. The dynamic window size is calculated through three conditions, as described in Equation 5, with different results depending on which threshold it is nearest the crash probability. In accordance with one embodiment, an instantaneous probability $p_i$ is compared to the thresholds to determine which n to use and in other embodiments, the average probability $\overline{p_t}$ is used recursively to find which n to use. The controlling hypothesis is that the noise in the crash probability will be higher around the selected thresholds so more samples are used to calculate the average unless the crash probability suddenly increase to values close to 100% in which case the averaging window is much smaller in order to reduce the delay in raising the alarm.

Figure 4:
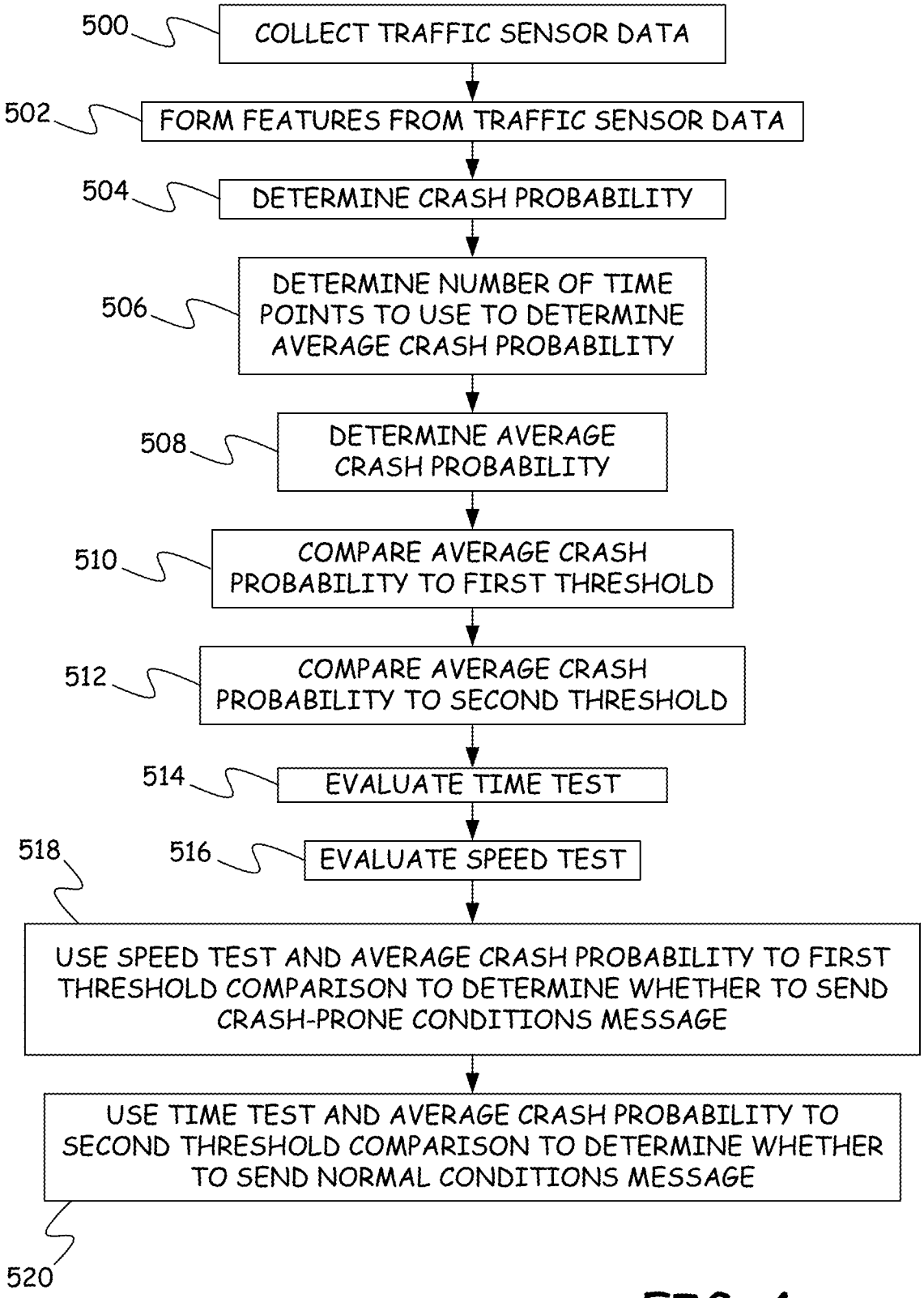
FIG. 4 is a flow diagram of a method for determining what messages to send to controllers of vehicles in accordance with one embodiment.

FIG. 4 provides a flow diagram of the steps involved in determining whether to issue or change messages sent to the controller of the vehicle. In step 500, traffic sensor data is collected using the various sensors described above. At step 502, the collected traffic sensor data is converted into features or metrics such as the features or metrics described above in sections 2.1, 2.2, and 2.3. At step 504, an instantaneous crash probability is determined based on the features/metrics using crash probability model 228. At steps 506 and 508, a dynamic windowing and crash probability averaging module 262 determines a number of past instantaneous crash probabilities to be used when calculating an average crash probability and determines the average crash probability from those instantaneous crash probabilities. The number of past crash probabilities to use in the average can be determined using a function that is based on a past average crash probability, the current average crash probability, or the current instantaneous crash probability. When the number of past crash probabilities to use in the average is dependent on the current average crash probability, the number of past crash probabilities to use and the current average crash probability can be determined recursively. At steps 510 and 512, the average crash probability is compared respectively to a first threshold and a second threshold by threshold testing 264 to produce two respective threshold results. At step 514, a time test 266 is evaluated that determines if more than a threshold amount of time has passed since the system entered and remained in an AlarmOn state. At step 516, a speed test 268 is evaluated to determine if the speed of at least one vehicle is below a threshold. At step 518, a message selection module 270 uses the results of the speed test and the comparison of the average probability to the first threshold to determine whether to send a crash-prone conditions message using equation 4 above. At step 520, message selection module 270 uses the results of the time test and the comparison of the average probability to the second threshold to determine whether to send a normal conditions message. The crash-prone conditions message or the normal conditions message forms the algorithm alarm result 272.

3.4 External Controls

Figure 5:
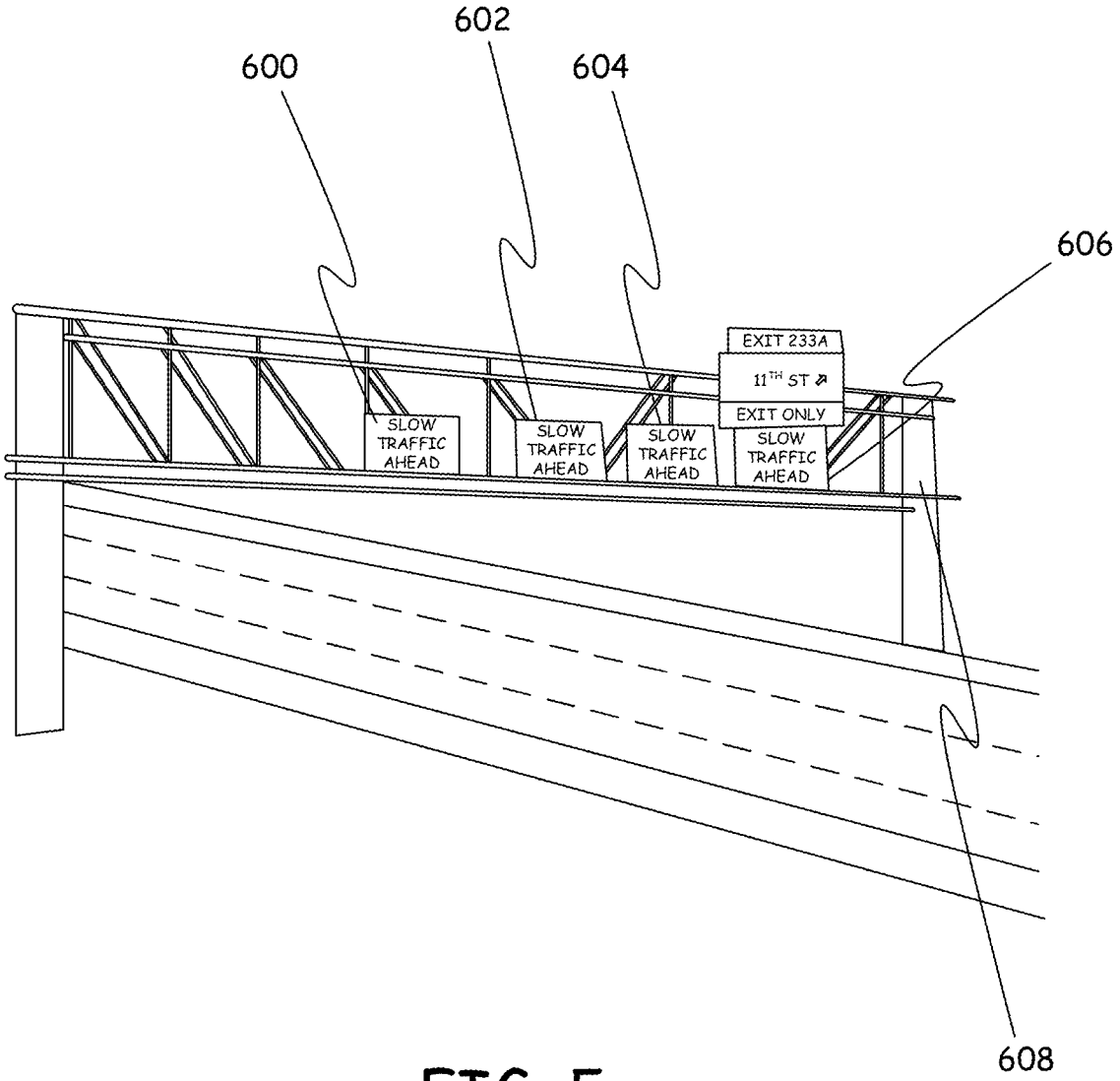
FIG. 5 provides a perspective view of a roadway showing changeable overhead signs that can convey messages to drivers.

In accordance with one embodiment, messages are conveyed to the controller of the vehicle through changeable message boards fixed to gantries above the freeway such as message signs 600, 602, 604, and 606 fixed to gantry 608 of FIG. 5. In accordance with some embodiments, the message recommendations are overridden at times to prevent messages from appearing on the message signs. These overrides are set as override rules 274 by a policy maker 276. A system control 278 receives algorithm alarm results 272 and compares them to override rules 274 to determine if the message recommendation from control algorithm 260 should be overridden or should be accepted when producing a final message to message sign 280 through ITS communication 282. For example, in one embodiment, a congestion override rule is provided that prevents the sign from being turned on when five consecutive 30-second average speed measurements at the loop detector before the farthest upstream sign are below a threshold of 25 mph. This override is intended to reduce driver overexposure to the warning by not displaying a warning when drivers are already travelling slowly. To assist in testing, system control 278 maintains a log 284 of when the message state of message signs 280 changes.

3.5 Interface and Control Station

In order to allow the users of QWARN to monitor the system and traffic conditions in real-time, a live feed of the model result, MVD data, sign status, and cameras used for event detection is available during the system's operation. The QWARN application has been developed to be able to operate from any kind of computer even in the cloud. All communications are Ethernet based so any instance of the application that has the right credentials can poll the MVDs for data and produce the warning messages.

The system has been developed to include several safety and redundancy features. The integration with the RTMC IRIS traffic operations system is performed through a secure web connection that makes hacking in to the system virtually impossible since the IRIS is polling the QWARN application every 30 sec for a message instead of pushing messages to the traffic operations system. Messages are not dynamically selectable so even if a hacker could take control of the system the "Slow Traffic Ahead" message is the only one they would be able to display. Finally, each message IRIS receives has a 45 sec lifetime so if the warning has been raised and the system crashes the sign will turn off after 45 seconds to avoid cases where the warnings are still up when conditions are non-crash prone or the congestion override has been invoked.

Figure 6:
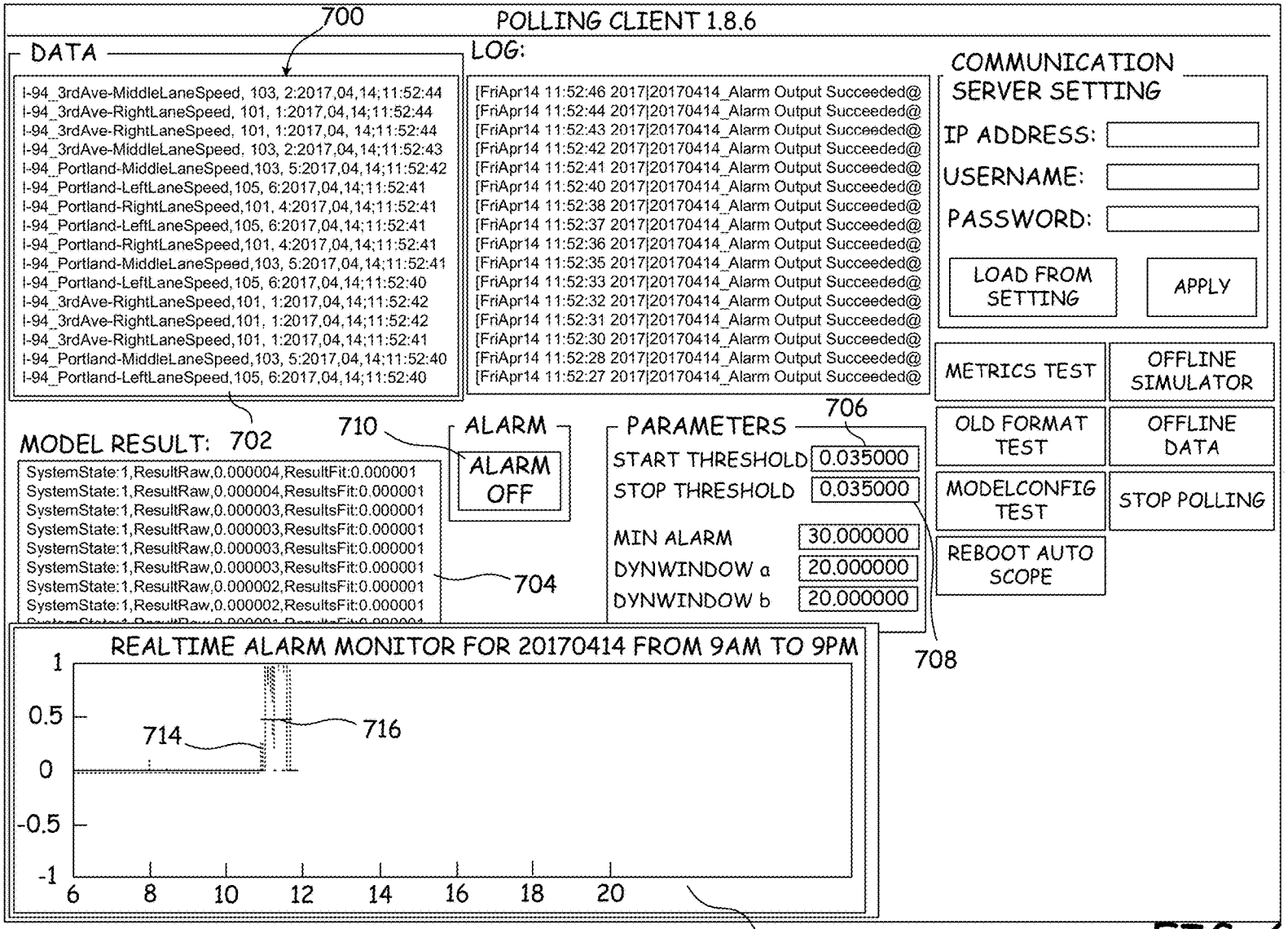
FIG. 6 provides an example user interface provided by a traffic messaging system in accordance with one embodiment.

A Picture of the GUI of the QWARN system is presented in FIG. 6. The top left window 700 shows the status of the data feed from the MVD sensors 702, the last 60 estimations of crash probability 704, raw and filtered, as well as the start warning message threshold 706 and end warning message threshold 708 under which the system is operating. The current state of the alarm/warning message is shown in box 710. In the bottom left window 712*t*, a continuously updating plot of the crash probability 714 determined by the model is displayed, together with the message state output 716 shown as a dotted line with the higher dotted line indicating that a warning message was shown and the lower dotted line indicating that no message was shown.

4 System Calibration and Validation 4.1 Calibration Basics

Calibration is important to optimize the performance of a system with a number of user defined parameters, such as the thresholds for the crash probability model and the speed test. Calibration requires knowledge of the ground truth and a set of metrics for evaluating system performance.

In the context of Intelligent Transportation Systems, Automated Incident Detection (AID) systems were the first examples of real-time detection and alarm traffic operations tools. Inevitably, those systems' characteristics influenced and shaped the definitions of performance metrics for this type of real-time application. The performance criteria focused on the efficiency, accuracy, and robustness of such systems. For AIDs the important factors were to generate an alarm as soon as possible after an incident event happened and to not generate alarms when no such incident event has taken place. These two objectives target accuracy both in terms of generating alarms for as many, if not all, of the events, as well as reducing alarms raised where no event has happened. Efficiency metrics targeted AID performance in minimizing human operator effort spend on false alarms. The accuracy metrics include the False Alarm Rate (FAR) and Detection Rate (DR), while the metric targeting efficiency is False Decision Rate (FDR). In the context of AIDs, FAR is usually the number of alarms raised while no incident was present divided by the total number of alarms generated while the system was running. DR is the number alarms raised when an incident happened divided by the total number of incidents occurred while the system was in operation. FDR is the combination of the missed-detection rate and false alarm rate. Detection systems are called to decide to raise or not raise the alarm for every time interval they operate on. FDR is the sum of all intervals the system raised the alarm but no incident existed and the intervals were an incident was present but the system did not raise the alarm, all divided by the total number of intervals the system was in operation. High DR and low FAR and FDR are preferred describing an accurate and efficient system. A tradeoff between FAR and DR is a common issue in such systems. An overly sensitive system may have a very high DR, but by being sensitive, it can raise the alarm while nothing happened, resulting in a high FAR.

Unfortunately, the aforementioned performance metrics, as defined, are not suitable for the evaluation of a CPC system like the various embodiments. When discussing these metrics it is important to note that the objective of AIDs is to detect an event that has happened and alert operators so they can initiate the process of incident response and clearance. AIDs did not interact with the drivers and did not aim in changing driving behavior to avoid the event that were designed to detect. The CPC system presented herein is a crash prevention system which implies the following:

- CPC detection systems aim to detect conditions that may lead to a crash but have not done so yet.
- Warn the drivers about to encounter CPCs and help them navigate through such unsafe conditions.
- Warning the drivers can also change driver behavior enough to eliminate the CPCs themselves.
- An AID raising the alarm when no incident happens is a clear failure, while for a CPC raising the alarm and nothing bad happening could mean failure if the conditions were not crash prone but it could mean success if a potential crash was avoided.
- Incidents are factual events and in extend the detection of their existence is a binary, true or false situation. The causal factors precipitating to a crash, as described in Hourdos, J., Garg, V., Michalopoulos, P., & Davis, G. (2006). *Real-Time Detection of Crash-Prone Conditions at Freeway High-Crash Locations*. Transportation Research Record, 1968(1), 83-91. doi: 10.3141/1968-10, include the traffic conditions described as crash prone but more importantly involve factors related to the individual drivers like reaction time, awareness, distraction, etc. Same exact CPCs can result in a crash if a distracted driver is involved and no crash or near-crash if all drivers involved are attentive.
- CPCs are traffic conditions where the probability of a crash is higher than normal, there is no objective way to definitively classify as crash prone a time period where no crash or near-crash has happened.

Using the aforementioned performance metrics as defined to judge the system in the various embodiments can result in overly conservative results and a calibrated system of much lower performance than the one possible to achieve. Therefore, there is a need for a more robust and leveled performance metric. Towards that effect, some embodiments utilize a new metric, the Alarm Efficiency Score (AES) that better fits the nature of a real-time driver warning system. The AES is calculated based on the historical crash likelihood score and the alarm results of the day on which the system performance is to be evaluated. Unlike the FAR, the AES is not in a percentage scale. Therefore, in terms of calibration, it only has meaning when comparing two or multiple results produced by different systems or the same system with different parameters. A higher AES indicates a better performance.

5 Historical Incident Likelihood Score

In accordance with one embodiment, a historical event likelihood approach is used to measure how dangerous a traffic condition can be. Given a certain time on a historical day, the similarity of the traffic condition during that time was compared with the traffic conditions when events happened and calculated a likelihood of an event.

5.1 Representation of Traffic Condition

For representing traffic states, vectors are defined that include up to ten elements, which can include traffic parameters such as volume, occupancy and speed at current and past points in time. In one particular embodiment, two separate ten-dimensional spaces, one of volume and one of occupancy, were defined. Each traffic condition is then represented by a pair of these ten-dimensional vectors, one for volume and one for occupancy. Equation 6 is an example of the vector of volume at time t, where a similar vector is constructed for occupancy. The value of the 10th dimension equals to the volume at time t.

$$\mathrm{vec}_{vol}(t)=(\mathrm{vol}_{t-9},\mathrm{vol}_{t-8},\mathrm{vol}_{t-7},\mathrm{vol}_{t-6},\mathrm{vol}_{t-5},\mathrm{vol}_{t-4},\mathrm{vol}_{t-3},\mathrm{vol}_{t-2},\mathrm{vol}_{t-1},\mathrm{vol}_{t}) \quad 6$$

Where $\mathrm{vec}_{vol}(t)$: The volume vector at time t;

$\mathrm{vol}_x$: The volume at time x;

t: Time;

In accordance with one embodiment, the volume and occupancy data from loop detectors were aggregated over time intervals such that t in equation 6 represents an index for a time segment that has a length equal to the time segment. The length of the time segments can be any desired value and such as 10 seconds, 20 seconds, or 30 seconds for example. Although loop detectors are mentioned above, individual vehicle measurements can also be used as long as they are aggregated to represent stable traffic flow over time.

5.2 Data Normalization

The natural distributions of volume and occupancy are different. In order to convert them into the same metric, the data are normalized and representation vectors are created. The normalization function is described in Equation 7. The normalization process involves subtracting the mean from volume data and then dividing by the standard deviation. The normalization for occupancy is the same as for volume.

$$vol_i' = \frac{vol_i - \frac{1}{n}\Sigma_{i=1}^{n} vol_i}{\sqrt{\frac{1}{n}\Sigma_{i=1}^{n}\left(vol_i - \frac{1}{n}\Sigma_{i=1}^{n} vol_i\right)^2}} \quad 7$$

Where $\mathrm{vol}_i'$: Normalized volume for time segment i;

$\mathrm{vol}_i$: Original volume for time segment i;

n: Total number of time segment;

5.3 Similarity

Some embodiments use similarity between a given traffic condition vector and all the condition vectors that precipitated to crashes and near crashes to assess the "dangerousness" of a traffic condition. The assumption is that, if a traffic condition is very similar to the majority of traffic conditions with crashes and near-crashes, such traffic condition tends to be dangerous, too.

There are many similarity measurements such as cosine similarity, Euclidean distance, and extended Jaccard similarity. In one embodiment, cosine similarity is chosen to demonstrate the evaluation methodology. Cosine similarity measures the angle of two high-dimensional vectors to determine their degree of likeness. As shown in Equation 8, the nature of cosine similarity makes it settle in the range (−1,1) which 1 representing the highest similarity.

$$\cos(\vec{A}, \vec{B}) = \frac{A * B}{\|\vec{A}\| \, \|\vec{B}\|} \tag{8}$$

Where A, B are two traffic vectors 5.4 Modeling Crash Likelihood

To evaluate the validity of a model-produced crash likelihood for a given traffic condition, the key logic is to first model the likelihood of a historical traffic during the given traffic condition.

Traffic measurements just before each historical event were extracted and used to formulate a set of historical traffic crash-prone conditions. Given a current traffic state represented in the two-vector approach, the similarity between the conditions before the historical events and the current traffic state can be calculated to measure the comprehensive similarity of the given traffic condition with historical ones associated with crashes. Based on the assumption that the higher similarity between a given traffic condition with those that resulted in crashes the higher probability there's a crash, the likelihood of crash can be estimated. Extending this to each day in the set of historical days used to evaluate the crash probability model, a map is constructed for each such day that contains the similarity of each time period with the set of vectors of known past events (crashes and near-crashes).

Figure 7:
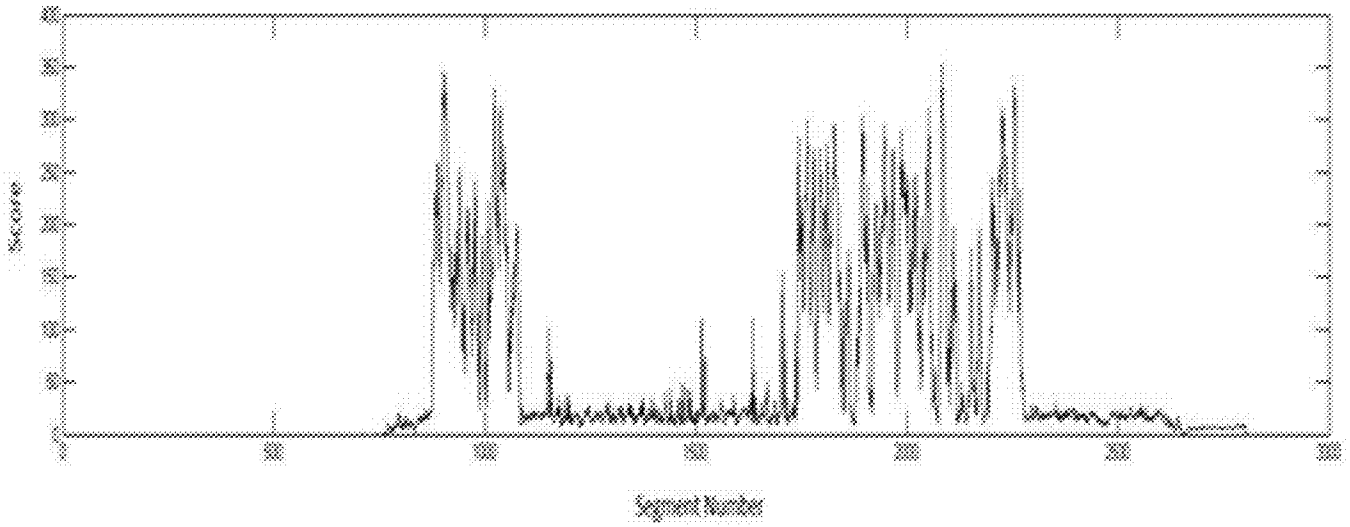
FIG. 7 provides a graph of instantaneous crash probability scores as a function of time.

This map describes the dangerousness of traffic conditions across each target day. The values in the map, termed as crash likelihood score, are produced by combining the similarities of the traffic condition vectors. For example, for the condition vectors of Equation 6, the crash likelihood is computed through Equation 9. This score will be different when the sample of historical crashes and near crashes is changed and when the vectors used to describe the traffic conditions are changed. Although it is not a percentage probability, it can quantify the dangerousness of different traffic conditions with a higher score meaning more dangerous traffic conditions as compared to similar conditions that did not result in a crash or near crash. This approach provides the means to more fairly evaluate the queue warning system even with crash-prone conditions that may not involve reckless drivers. FIG. 7 shows the values of the crash likelihood score during a target day.

$$L_{i,t} = \sum_{n} (\mathrm{Cos}(V_{d,t}, V_{i,t}) \times \mathrm{Cos}(O_{d,t}, O_{i,t})) \tag{9}$$

-continued $$\mathrm{Cos}(A, B) = \begin{cases} \mathrm{Cos}(A, B) & \mathrm{Cos}(A, B) > 0 \\ 0 & \text{else} \end{cases}$$

5.5 Alarm Efficiency Score

The alarm efficiency score is a measure of how efficiently a warning system operates over a certain period of time such as a day, a month, or a year. Equation 10 shows the mathematical formulation of such score. There are two components in the equation with the first part measuring the efficiency of all of the active alarms and second component serves as a penalty term for not warning about dangerous conditions. For an efficient queue warning system, it is desirable to cover as many dangerous traffic conditions as possible in the process of minimizing the total warning duration.

Assuming the evaluation period is a day, the first term in Equation 10 becomes the summation of crash likelihood score for all traffic conditions with the alarm being up, divided by the time that the alarm is up for this day. It is a density of historical crash likelihood approach and favors the system cover more crash likelihood score with a short alarm duration. Similarly, the second term becomes the summation of crash likelihood score for all traffic conditions with the alarm being down, divided by the time that the alarm is not up for the day.

$$E = \frac{\Sigma_{t_{on}} L_{ON}}{t_{ON}} - \frac{\Sigma_{tOFF} L_{OFF}}{t_{OFF}} \tag{10}$$

Figure 8:
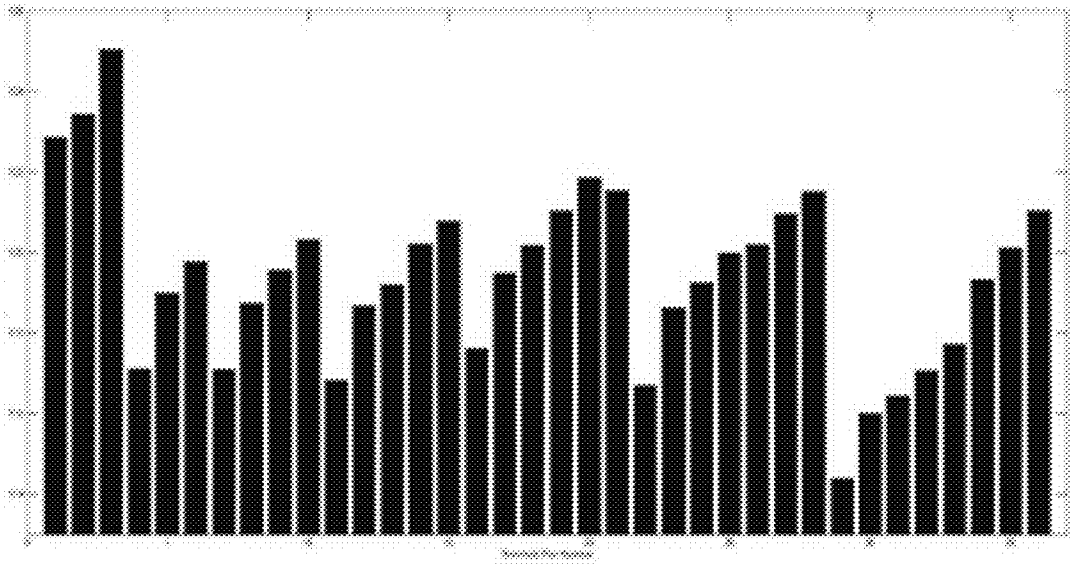
FIG. 8 provides a graph of alarm efficiency scores.

Given different pairs of thresholds, different alarm efficiency scores can be calculated for the result of each of these threshold pairs as a means to compare their performances. FIG. 8 shows the alarm efficiency score for different pairs of thresholds from {0.2,0.1} ({Start Threshold, Stop Threshold}) to {0.9,0.8} with a step of 0.1 for each threshold.

6 Results and Discussion 6.1 Detection Rates

To assess the performance of the system, the detection rate of all conflict events between 3rd Ave and Chicago Ave during a three-month evaluation period was calculated separately for the control algorithm and for the system as a whole. The detection rate was calculated for just the crashes, near crashes, and both events combined. To find the actual number of conflict events, all the events observed during the evaluation period were tabulated and sorted based on whether the drivers involved were warned or not warned about crash-prone conditions before the event and if not separated by the reason for such failure (the results are tabulated in Table 2).

TABLE 2

Breakdown of system performance in right lane by component

| Reason For Failure to Warn Driver | Event Type: Crashes [Count] | Crashes [% of Tot.] | Near Crashes [Count] | Near Crashes [% of Tot.] | All Events [Count] | All Events [% of Tot.] |
|---|---|---|---|---|---|---|
| Driver warned | 15 | 36.6% | 70 | 49.0% | 85 | 47.3% |
| System buffering or inoperative | 3 | 7.3% | 8 | 5.6% | 11 | 6.0% |
| Alarm was not raised | 9 | 22.0% | 28 | 19.6% | 37 | 20.1% |
| congestion override in place | 8 | 19.5% | 10 | 7.0% | 18 | 9.8% |
| time override in place | 4 | 9.8% | 25 | 17.5% | 29 | 16.8% |
| System delay | 2 | 4.9% | 2 | 1.4% | 4 | 2.2% |
| Total | 41 | | 143 | | 184 | |

Using the results shown in Table 2, the detection rates were calculated. To assist the reader in comparing the different detection rates and to measure the effect the overrides have on the system performance the results are separated in two categories; one is based on the algorithm decision and the other is based on the whole system which is the algorithm plus the overrides. In addition, these results are grouped into two categories based on time period; one for the full time surveillance data were available (9 am to 8 pm) and the other for the system operational period of noon to 8 pm.

The results are tabulated in Table 3 which shows the rates at which various event types were detected by the algorithm and the rates at which the system as a whole provided a warning to the drivers involved in those events.

TABLE 3

Detection rates during the evaluation period

| Detecting Component | Event Type: Crashes [%] | Near Crashes [%] | Both [%] |
|---|---|---|---|
| Algorithm (9 a.m. to 8 p.m.) | 76.3 | 79.3 | 78.6 |
| Whole System (9 a.m. to 8 p.m.) | 39.5 | 51.9 | 49.0 |
| Algorithm (noon to 8 p.m.) | 73.5 | 74.6 | 74.3 |
| Whole System (noon to 8 p.m.) | 44.1 | 63.6 | 59.2 |

It is apparent that the control algorithm is far more successful at raising the alarm for events than the system as a whole. The noon to 8 pm group illustrated the effect of the congestion override. As seen in Table 3, following a successful detection by the control algorithm, the main reason the sign was not activated is the presence of an override.

TABLE 4

Event frequencies per million vehicles traveled (VMT)

| Observation | Observation Zone MN 65 to Portland Ave: Without System | With System |
|---|---|---|
| Crashes | 11.9 | 9.34 |
| Near Crashes | 111.8 | 51.8 |

Table 4 shows the frequencies at which events occurred in any lane between 9 a.m. and 8 p.m. on weekdays with and without the system. It is apparent that there was a 22% decrease in crashes and a 54% decrease in near crashes in the zone following the implementation of the various embodiments.

6.2 System False Alarm Rate

The main concern when implementing the system was minimizing overexposure of drivers to the warning sign. This concern is what prompted MnDOT to impose what, in hindsight, turned out to be a somewhat excessive congestion override. From all types of overexposure, the case of a driver seeing a warning about slow or stopped traffic but not having to slow or stop is the one that must be avoided the most. Because the transition from crash-prone conditions to free-flow conditions occurs very suddenly (less than two minutes), the crash likelihood model has a tendency to continue outputting crash probabilities indicative of crash-prone conditions for up to 15 minutes after uncongested flow conditions have been restored. In order to reduce the false alarm rate coming from this delay, an override was built into the control algorithm to deactivate the alarm, regardless of the model result at the time, when both MVDs observe 10 consecutive vehicles with speeds greater than 30 mph. This tendency and the need of the subsequent speed test is necessary because the embodiment tested is the one with only one Crash Probability layer. The embodiment that considers the traffic state transition and chooses the most appropriate Crash Probability model will not need this override because it will have an inherent state transition detection method which will detect the transition to free flow and terminate the alarm.

Figure 9:
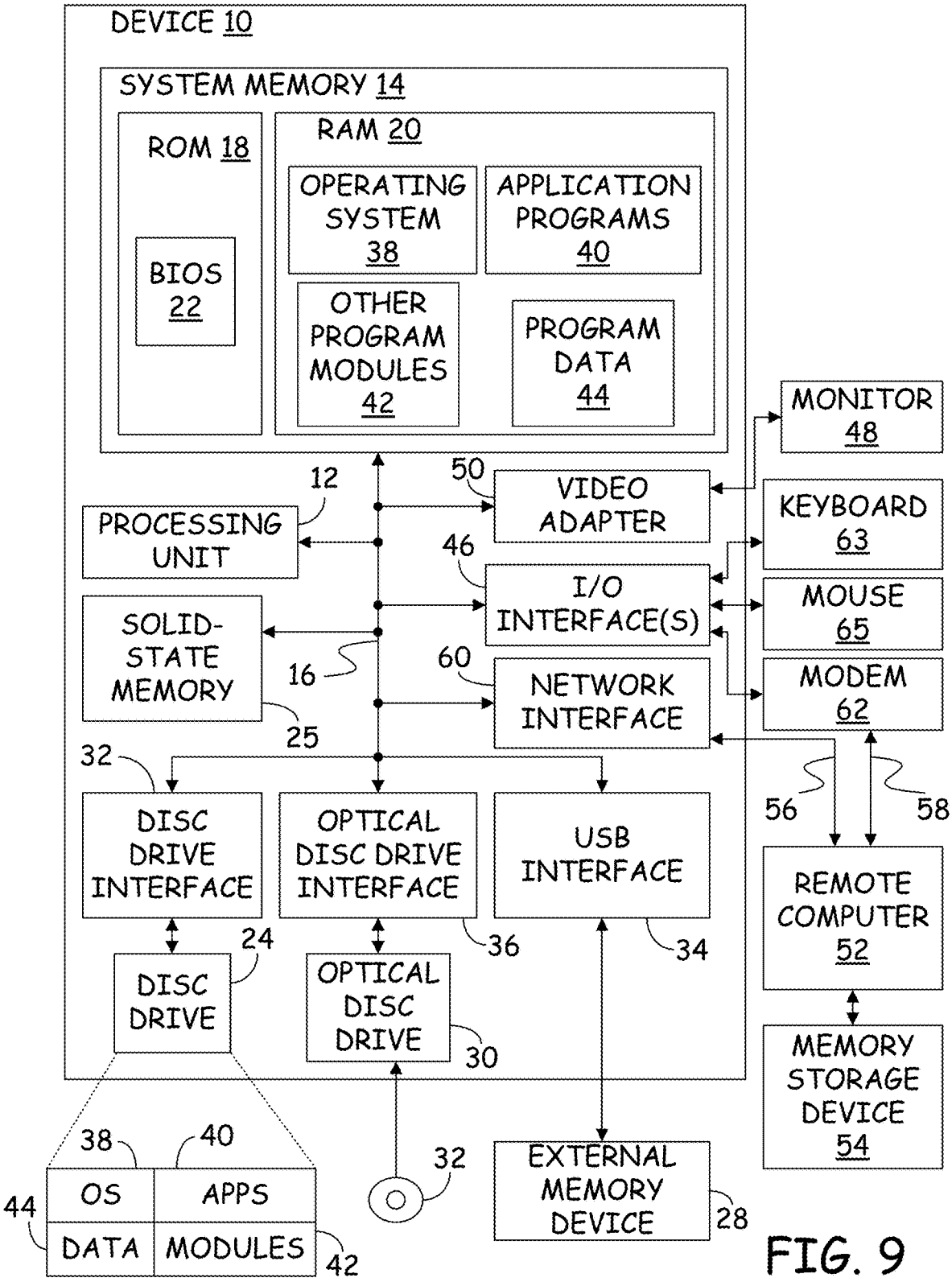
FIG. 9 is a block diagram of a computing system that is used as a server or client device in accordance with the various embodiments.

An example of a computing device 10 that can be used as a server and/or client device in the various embodiments is shown in the block diagram of FIG. 9. For example, computing device 10 may be used to perform any of the steps described above. Computing device 10 of FIG. 9 includes a processing unit (processor) 12, a system memory 14 and a system bus 16 that couples the system memory 14 to the processing unit 12. System memory 14 includes read only memory (ROM) 18 and random access memory (RAM) 20. A basic input/output system 22 (BIOS), containing the basic routines that help to transfer information between elements within the computing device 10, is stored in ROM 18.

Embodiments of the present invention can be applied in the context of computer systems other than computing device 10. Other appropriate computer systems include handheld devices, multi-processor systems, various consumer electronic devices, mainframe computers, and the like. Those skilled in the art will also appreciate that embodiments can also be applied within computer systems wherein tasks are performed by remote processing devices that are linked through a communications network (e.g., communication utilizing Internet or web-based software systems). For example, program modules may be located in either local or remote memory storage devices or simultaneously in both local and remote memory storage devices. Similarly, any storage of data associated with embodiments of the present invention may be accomplished utilizing either local or remote storage devices, or simultaneously utilizing both local and remote storage devices.

Computing device 10 further includes a hard disc drive 24, a solid state memory 25, an external memory device 28, and an optical disc drive 30. External memory device 28 can include an external disc drive or solid state memory that may be attached to computing device 10 through an interface such as Universal Serial Bus interface 34, which is connected to system bus 16. Optical disc drive 30 can illustratively be utilized for reading data from (or writing data to) optical media, such as a CD-ROM disc 32. Hard disc drive 24 and optical disc drive 30 are connected to the system bus 16 by a hard disc drive interface 32 and an optical disc drive interface 36, respectively. The drives, solid state memory and external memory devices and their associated computer-readable media provide nonvolatile storage media for computing device 10 on which computer-executable instructions and computer-readable data structures may be stored. Other types of media that are readable by a computer may also be used in the exemplary operation environment.

A number of program modules may be stored in the drives, solid state memory 25 and RAM 20, including an operating system 38, one or more application programs 40, other program modules 42 and program data 44. For example, application programs 40 can include instructions for performing any of the steps described above. Program data can include any data used in the steps described above.

Input devices including a keyboard 63 and a mouse 65 are connected to system bus 16 through an Input/Output interface 46 that is coupled to system bus 16. Monitor 48 is connected to the system bus 16 through a video adapter 50 and provides graphical images to users. Other peripheral output devices (e.g., speakers or printers) could also be included but have not been illustrated. In accordance with some embodiments, monitor 48 comprises a touch screen that both displays input and provides locations on the screen where the user is contacting the screen.

Computing device 10 may operate in a network environment utilizing connections to one or more remote computers, such as a remote computer 52. The remote computer 52 may be a server, a router, a peer device, or other common network node. Remote computer 52 may include many or all of the features and elements described in relation to computing device 10, although only a memory storage device 54 has been illustrated in FIG. 9. The network connections depicted in FIG. 9 include a local area network (LAN) 56 and a wide area network (WAN) 58. Such network environments are commonplace in the art.

Computing device 10 is connected to the LAN 56 through a network interface 60. Computing device 10 is also connected to WAN 58 and includes a modem 62 for establishing communications over the WAN 58. The modem 62, which may be internal or external, is connected to the system bus 16 via the I/O interface 46.

In a networked environment, program modules depicted relative to computing device 10, or portions thereof, may be stored in the remote memory storage device 54. For example, application programs may be stored utilizing memory storage device 54. In addition, data associated with an application program may illustratively be stored within memory storage device 54. It will be appreciated that the network connections shown in FIG. 9 are exemplary and other means for establishing a communications link between the computers, such as a wireless interface communications link, may be used.

Although the present invention has been described with reference to preferred embodiments, workers skilled in the art will recognize that changes may be made in form and detail without departing from the spirit and scope of the invention.

What is claimed is:

1. A method comprising:

using sensors to collect information about vehicles on a road;

determining a plurality of crash probabilities based on the collected information, each crash probability indicating a probability of a vehicular crash on the road at a respective point in time;

averaging the plurality of crash probabilities to form an average crash probability wherein averaging the plurality of crash probabilities comprises using a current crash probability to determine how many past crash probabilities to include in the plurality of crash probabilities that are averaged; and using the average crash probability to determine when to provide a message to a controller of a vehicle.

2. The method of claim 1 wherein providing a message to a controller of a vehicle comprises changing an electronic road sign.

3. The method of claim 1 wherein using the current crash probability to determine how many past crash probabilities to include comprises using the current crash probability and a threshold probability to determine how many past crash probabilities to include.

4. The method of claim 3 wherein determining how many past crash probabilities to include comprises using more past crash probabilities when the current crash probability is closer to the threshold.

5. The method of claim 1 wherein using the average crash probability to determine when to provide the message comprises using the average crash probability and a current velocity of at least one vehicle on the road to determine when to provide the message.

6. The method of claim 1 wherein using the average crash probability to determine when to provide the message comprises selecting a threshold based on a last message provided to the controller of the vehicle and comparing the average crash probability to the chosen threshold.

7. The method of claim 6 wherein using the average crash probability to determine when to provide the message further comprises using a time since a last message to determine when to provide the message.

8. A system comprising:

at least one traffic sensor capable of providing a sensor signal indicative of traffic on a road;

a processor:

receiving the sensor signal provided by the at least one traffic sensor;

using the sensor signal to determine a crash probability that indicates a likelihood of a crash occurring; and using the crash probability and a current velocity of at least one vehicle to determine whether to notify a controller of a vehicle that crash-prone conditions are present on the road wherein using the crash probability comprises determining an average crash probability from a plurality of crash probabilities, each crash probability associated with a separate time point, and using the average crash probability to determine whether to notify the controller of the vehicle that crash-prone conditions are present on the road by comparing the average crash probability to a threshold that is selected based on a last notification provided to the controller of the vehicle.

9. The system of claim 8 wherein determining the average crash probability comprises determining a number of past crash probabilities to average based on a current crash probability.

10. The system of claim 9 wherein determining the number of past crash probabilities to average further comprises determining the number based on the proximity of the current crash probability to a threshold probability.

11. The system of claim 8 wherein determining whether to notify a controller of a vehicle that crash-prone conditions are present on the road further comprises determining a length of time since the controller was first notified that crash-prone conditions are present on the road.

12. A method comprising:

determining a sequence of traffic conditions on a road based on a signal from at least one traffic sensor;

using the sequence of traffic conditions to select a function for computing a crash probability;

using the selected function to compute a plurality of crash probabilities; and averaging the plurality of crash probabilities to form an average crash probability wherein averaging the plurality of crash probabilities comprises using a current crash probability to determine how many past crash probabilities to include in the plurality of crash probabilities that are averaged;

using the average crash probability to determine when to provide a message to a controller of a vehicle on the road.

13. The method of claim 12 wherein different the sequences of traffic conditions have different functions for computing crash probability.

14. The method of claim 12 wherein using the crash probability comprises using the crash probability to form an average crash probability over a plurality of time points and comparing the average crash probability to a threshold.

15. The method of claim 14 wherein using the crash probability further comprises using the crash probability to select how many time points to include in the plurality of time points.

16. The method of claim 12 wherein using the crash probability to determine whether to provide a message to a controller of a vehicle further comprises using the crash probability with a velocity of a vehicle on the road to determine whether to provide the message.

17. The method of claim 12 wherein using the crash probability to determine whether to provide a message to a controller of a vehicle further comprises using a time since a last message change to determine whether to provide the message.

* * * * *